US005944587A

United States Patent [19]

Stadtfeld

[11] Patent Number: 5,944,587

[45] Date of Patent: Aug. 31, 1999

[54] CUTTING EDGE ROUNDING METHOD

[75] Inventor: Hermann J. Stadtfeld, Rochester, N.Y.

[73] Assignee: The Gleason Works, Rochester, N.Y.

[21] Appl. No.: 08/902,472

[22] Filed: Jul. 29, 1997

[51] Int. Cl.[6] ..... B24B 9/06; B24B 3/36

[52] U.S. Cl. ..... 451/59; 451/48

[58] Field of Search ..... 451/59, 48, 28, 451/374, 367

[56] References Cited

U.S. PATENT DOCUMENTS

| | | | |
|---|---|---|---|
| 2,353,683 | 7/1944 | Martines | 451/59 |
| 3,192,604 | 7/1965 | Whitmore . | |
| 4,170,091 | 10/1979 | Ellwanger et al. . | |
| 4,263,754 | 4/1981 | DeTorre | 451/48 |
| 4,530,623 | 7/1985 | Kotthaus . | |
| 4,575,285 | 3/1986 | Blakesley . | |
| 4,646,479 | 3/1987 | Walker et al. | 451/59 |
| 5,168,661 | 12/1992 | Pedersen et al. . | |
| 5,503,588 | 4/1996 | Sweet . | |

FOREIGN PATENT DOCUMENTS

| | | | |
|---|---|---|---|
| 4124417 | 3/1992 | Germany . | |
| 59-115150 | 7/1984 | Japan . | |
| 4300150 | 10/1992 | Japan . | |
| 0013574 | of 1891 | United Kingdom | 451/59 |
| 9513894 | 5/1995 | WIPO . | |

OTHER PUBLICATIONS

Patent Abstracts of Japan, vol. 017, No. 114 (M–1377), Mar. 9, 1993, Mitsubishi Materials Corp., Publication No. 4–300150, Publication Date Oct. 10, 1992.

Patent Abstracts of Japan, vol. 008, No. 234 (M–334), Oct. 26, 1984, Hitachi Choko K.K., Publication No. 59–115150, Publication Date Jul. 3, 1984.

*Primary Examiner*—Robert A. Rose

*Attorney, Agent, or Firm*—Robert L. McDowell

[57] ABSTRACT

A method of treating a cutting edge of a tool to reduce deterioration of the cutting edge during a subsequent machining operation. A brush having a plurality of bristles is rotated about an axis of rotation and positioned relative to the cutting edge whereby the brush axis is oriented perpendicular to the cutting edge or at an angle of up to about plus/minus 20 degrees with respect to the perpendicular orientation. The brush is then brought into contact with the cutting tool in the presence of an abrasive material. Preferably the cutting tool is a cutting blade for cutting toothed articles such as gears and the like wherein the cutting edge is formed by the intersection of a front face and a cutting side profile surface of the cutting blade. The rotating brush effectively polishes a portion of the front face and cutting side profile surface which is adjacent to the cutting edge while producing the rounding-off of the cutting edge.

13 Claims, 4 Drawing Sheets

CUTTING EDGE ROUNDING METHOD

FIELD OF THE INVENTION

The present invention is directed to tools for machining toothed articles such as gears and the like. In particular, the present invention is directed primarily to carbide tools and to a method and apparatus for reducing degradation of the tool cutting edge during machining.

BACKGROUND OF THE INVENTION

Cutting tools comprising a plurality of cutting blades projecting axially from the face or periphery of a circular cutter head are well known for producing bevel ring gears and pinions by face milling or face hobbing processes. Such tools and/or cutting blades can be seen, for example, in U.S. Pat. No. 4,575,285 to Blakesley; U.S. Pat. No. 3,192,604 to Whitmore; or, U.S. Pat. No. 4,530,623 to Kotthaus. Cutting blades such as those discussed in these patents are usually formed of high speed steel but may also comprise carbide material composites (e.g. cemented carbides) formed by powder metallurgy processes. Such composites comprising, for example, tungsten carbide (WC) in a cobalt (Co) matrix.

When it becomes necessary to sharpen a cutting blade, one or more surfaces of the cutting blade are usually ground to restore the cutting edge to an acceptable cutting condition. For example, in the stick-type cutting blades disclosed by U.S. Pat. No. 4,575,285, only the cutting side and clearance side flank surfaces need to be ground to sharpen the cutting edge. Sharpening cutting blades of this type may be accomplished in several known ways among which are the methods disclosed in U.S. Pat. No. 4,170,091 to Ellwanger et al. or U.S. Pat. No. 5,168,661 to Pedersen et al. In U.S. Pat. No. 4,503,623, which also discloses sticktype cutting blades, the side surfaces are likewise ground but it is also necessary to grind the front surface in order to sharpen the cutting blades.

The cutting blades described in U.S. Pat. No. 3,192,604 are of the known form-relieved type and these cutting blades are sharpened by grinding of the front face only. An example of a process for sharpening form-relieved cutting blades can be found in U.S. Pat. No. 5,503,588 to Sweet.

Subsequent to sharpening of many cutting blades, especially those comprising brittle materials such as carbides, it is appropriate, or even necessary, to treat the cutting edge in some manner to prevent it from chipping at the beginning of the cutting operation. In carbide materials, one reason for chipping is that carbide/metal-matrix composite is very brittle and a very sharp cutting edge presents a problem in that, at the thin cutting edge, the particles of carbide (e.g. WC) and/or matrix material (e.g. Co) are not supported sufficiently. The cutting process, especially at the beginning of the cutting process, tends to break away some of the inadequately supported particles, particularly carbide particles, from the cutting edge resulting in pockets formed in the cutting edge thus marring the surface being machined.

Previous efforts to address the breaking-away condition of a cutting edge have been directed to forming a defined radius along the cutting edge. The radius, in comparison to a sharper edge, leads to a more stable cutting operation and uniform wear. Carbide particles along the cutting edge are exposed to significantly less chipping. Some of the methods of rounding cutting edges are sand blasting with silicon carbide, drum rotation with abrasive particles, hand filing using a soft steel pipe, and grinding or polishing with brushes.

It is known, for example, to treat carbide cutting inserts with a rotating brush approaching the cutting edge at an angle of between 45 degrees and 90 degrees and moving along the entire width of the cutting edge. The rotating brush comprises nylon bristles having a cross-section of one square millimeter (1 $mm^2$) and having 120 grid silicon carbide incorporated into the nylon bristles. The surface speed of the rotating brush in the edge treating operation is 50 feet per second (15 meters/second).

However, in the case of cutting tools for toothed articles, and in particular stick-type carbide cutting blades for cutting bevel and hypoid gears, the above methods have proven to be unsuccessful. For example, a bevel gear stick-type cutting blade has a cross section of up to ¾ inch×¾ inch (19 mm×19 mm) and may have a cutting edge ground onto it with a length of 1 inch (25.4 mm). The cutting edge is formed by the intersection of the cutting side flank surface, which is relieved at an angle of, for example, 6 degrees, and the front face which is oriented at a particular rake angle usually in the range of −20 degrees to +20 degrees.

The distribution of the dimensions and shape of the bevel cutting stick-type blade is not comparable to any other existing carbide tools for milling, turning or hobbing operations. As such, the previously mentioned methods have failed to provide a sufficient treatment of the cutting edge. Hand treating is inconsistent. Brushing, by the method discussed above, breaks carbide particles out of the cutting edge rather than rounding it properly. Sand blasting produces an undefined radiused cutting edge in conjunction with roughening the surface of the cutting side profile surface and the front face. Drum rotation with a particulate abrasive is not suitable due to the weight and dimension of stick-type cutting blades, particularly cutting blades made of carbide material.

It is an object of the present invention to provide a method of rounding the cutting edge of a cutting blade for producing toothed articles that substantially reduces or eliminates breakage of particles out of the cutting edge.

SUMMARY OF THE INVENTION

The present invention is directed to method of treating a cutting edge of a tool to reduce deterioration of the cutting edge during a subsequent machining operation. The method comprises providing a tool having a shank portion and a cutting end portion with the cutting end portion including a cutting edge. A rotatable brush having an axis of rotation and a plurality of bristles arranged about the axis is positioned relative to the cutting edge such that the brush axis is oriented perpendicular to the cutting edge or at an angle of up to about plus/minus 20 degrees with respect to the perpendicular orientation. The brush is then rotated and brought into contact with the cutting edge in the presence of an abrasive material to effect a rounding-off of the cutting edge.

Preferably the cutting tool is a cutting blade, such as a carbide cutting blade, for cutting toothed articles such as gears and the like wherein the cutting edge is formed by the intersection of a front face and a cutting side profile surface of the cutting blade. The rotating brush effectively polishes a portion of the front face and cutting side profile surface which is adjacent to the cutting edge while producing the rounding-off of the cutting edge.

DETAILED DESCRIPTION OF THE PREFERRED EMBODIMENT

The preferred embodiment of the present invention will now be discussed in detail with reference to the accompanying drawing FIGS.

Figure 1:
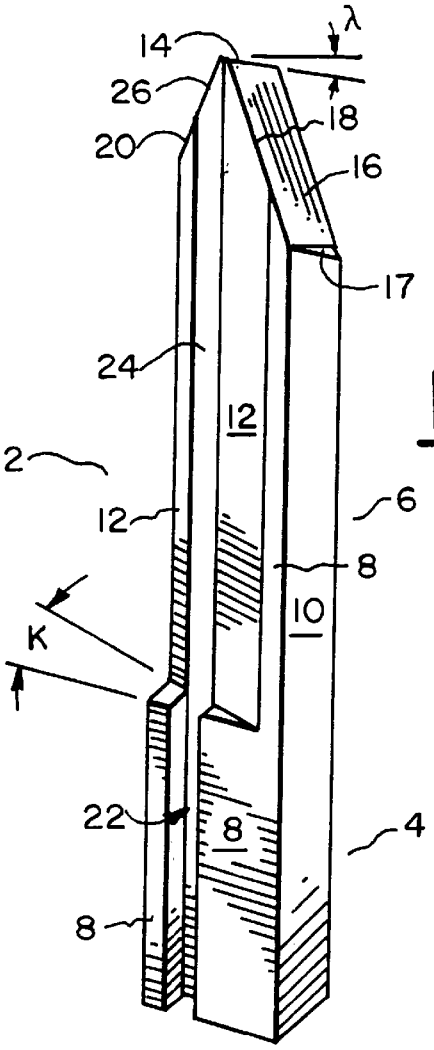
FIG. 1 is an isometric view of a known stick-type cutting blade.
Figure 2:
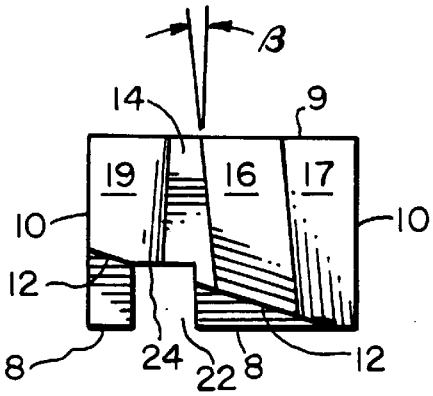
FIG. 2 illustrates a top view of the cutting blade of FIG. 1.

FIGS. 1 and 2 illustrate a stick-type cutting blade for forming bevel gears as disclosed by previously mentioned U.S. Pat. No. 4,575,285. This type of cutting blade is used primarily for face hobbing processes in both soft cutting and hard cutting (skiving) operations and may be made of carbide materials such as tungsten carbide and cobalt, or, M2 high speed steel.

The cutting blade 2 comprises a shank portion 4 and a cutting end portion 6. The shank portion 4 has an essentially rectangular cross section for positioning the cutting blade 2 in the mounting slot of a cutter head (not shown) as is known to the skilled artisan. Cutting blade 2 further includes a back surface 9, opposing side surfaces 10 and a front rake surface 12 extending the length of the cutting end portion 6 and oriented at a desired rake angle K with respect to the front surface 8. Usually, the rake angle K is oriented at an angle between −20 degrees and +20 degrees.

The cutting end portion 6 includes a blade tip 14, cutting side profile surface 16, shoulder 17 and a clearance side profile surface 19. Tip 14 is relieved at an angle λtoward the back surface 9 and the cutting side profile surface 16 is also relieved at an angle 13 toward the back surface 9. The magnitudes of the tip relief and cutting side relief angles are dependent on the particular workpiece being cut as is understood by the skilled artisan. The intersection of the front rake face 12 with the cutting side profile surface 16 forms cutting edge 18 while the intersection of front rake face 12 with the clearance side profile surface 19 forms clearance edge 20. Additionally, cutting blade 2 further comprises a slot 22 formed in its front surface and extending the length thereof. The slot 22 forms a second rake surface 24 oriented at a second rake angle in the cutting end portion 6. The intersection of rake surface 24 with the clearance side profile surface 19 forms secondary cutting edge 26 which cuts a portion of the bottom of a tooth slot as well as a portion of the flank opposite of that being cut by cutting edge 18.

The cutting blade shown in FIGS. 1 and 2 is of the type known as a "profile-sharpened" cutting blade and is sharpened by grinding the cutting side 16 and clearance side 19 profile surfaces to restore the cutting edge 18 and secondary cutting edge 26 to their proper form for cutting. However, as discussed above, when the cutting blade is made of brittle material, such as carbide, a subsequent rounding-off process may be carried out in order to lessen chipping of the cutting edge during the cutting operation, particularly at the beginning of cutting.

Previous methods which have attempted to produce a rounded-off or radiused cutting edge have, particularly in the case of brushing carbide cutting blades, actually caused particles to break away from the cutting edge thus causing the problem they were intended to prevent. It is believed this is due primarily to the feed direction of the brush which approaches the cutting edge at an angle of 45–90 degrees thereto and traverses across the cutting edge. Since grinding the cutting side profile surfaces during sharpening produces minute grinding lines that extend generally from the front face to the back face (i.e. at about 90 degrees with respect to the cutting edge), the approach of the brush in generally the same direction is believed to further enhance the effects of grinding thus, in effect, further abrading the profile surface. At the cutting edge, this enhanced abrading action accentuates the grinding effects on the thin, sharp edge thus breaking the already tenuously supported particles away from the cutting edge.

Figure 3:
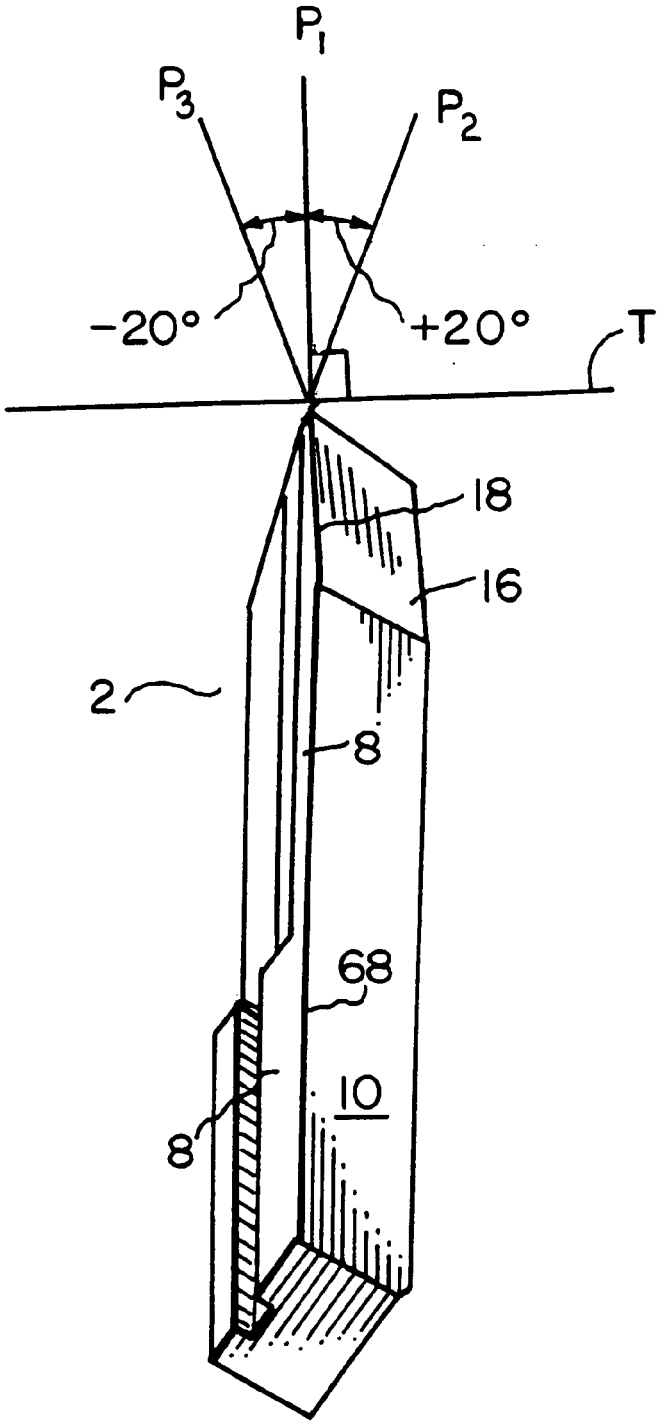
FIG. 3 shows the orientation of the brush axis relative to the cutting edge of a cutting blade.

It has now been discovered that by contacting a rotating brush and the cutting edge in the presence of an abrasive material with the axis of the brush oriented at an angle of up to about plus/minus 20 degrees (+/−20°) with respect the cutting edge, a rounding-off of the cutting edge is produced. Preferably, the angle of orientation is ninety degrees (90°) with respect to the cutting edge, that is, perpendicular to the direction of the cutting edge. The orientation of the rotating brush is shown in FIG. 3 where the preferred perpendicular orientation with respect to the brush axis T is shown by $P_1$. Angles $P_2$ and $P_3$ illustrate the limits of the brush orientation with respect to cutting edge 18, $P_2$ being oriented at +20° with respect to the cutting edge 18 and $P_3$ being oriented at −20° with respect to cutting edge 18. Hence, angles $P_2$ and $P_3$ each vary up to about −20° from the perpendicular orientation shown by $P_1$.

Is it preferred to feed the rotating brush relatively toward the cutting edge such that bristles from the brush also contact those surfaces of the cutting blade on each side of the cutting edge, that is, those surfaces which intersect to form the cutting edge. For example, as shown in FIG. 2, cutting edge 18 is formed by the intersection of cutting side profile surface 16 and front rake surface 12. In the rounding-off method of the present invention, it is preferred to orient the cutting blade relative to the rotating brush such that a portion of the bristles contact both the cutting side profile surface 16 and the front rake surface 12. It has been found that with such contact, a polishing effect is realized on each of the surfaces adjacent to the cutting edge. A polished band is formed on each surface which preferably extends to a width of about 1 mm. Since the brush axis T lies approximately perpendicular to grinding lines resulting from sharpening, the polishing marks or lines will be oriented across the grinding lines effectively smoothing the area in the polished band and thus, enhancing tool life.

The type of brush utilized in the process may vary. In one example, a brush with nylon bristles each having a cross-sectional area of 1 $mm^2$ and having 120 grid silicon carbide incorporated in each bristle was positioned by orienting the brush axis perpendicular to the cutting edge, rotated at 50 ft/sec (15 m/sec) and plunged into contact with the cutting edge of a carbide (WC and Co) cutting blade for about 10 seconds. Thus, the angular orientation of the brush axis was as designated by $P_1$ in FIG. 3.

In another example, a brush with nylon bristles each having a diameter of 0.020 inch (0.51 mm) and integrated with 400 grid silicon carbide was positioned by orienting the brush axis perpendicular to the cutting edge (see $P_1$ in FIG. 3), rotated at 100 ft/sec (30.5 m/sec) and plunged into contact with the cutting edge of a carbide (WC and Co) cutting blade of the type shown in FIG. 3, for about 20 seconds.

In both examples, a radiused cutting edge was formed with the coarser brush (1 $mm^2$ bristles) forming a larger radiused surface than the brush having the 0.020 inch bristles. No breaking-away of particles from the cutting edge was noted. A polished band on the front face and cutting side profile surfaces adjacent the cutting edge was noted in both examples.

As a comparison, the brushes described above were traversed across the cutting edge of the same type of carbide cutting blade at an angle of approximately 90 degrees with respect to the cutting edge (i.e. brush axis oriented parallel to the cutting edge). An examination of the cutting edge subsequent to these treatments revealed pitting of the cutting edge resulting from particles being broken away therefrom.

Figure 5:
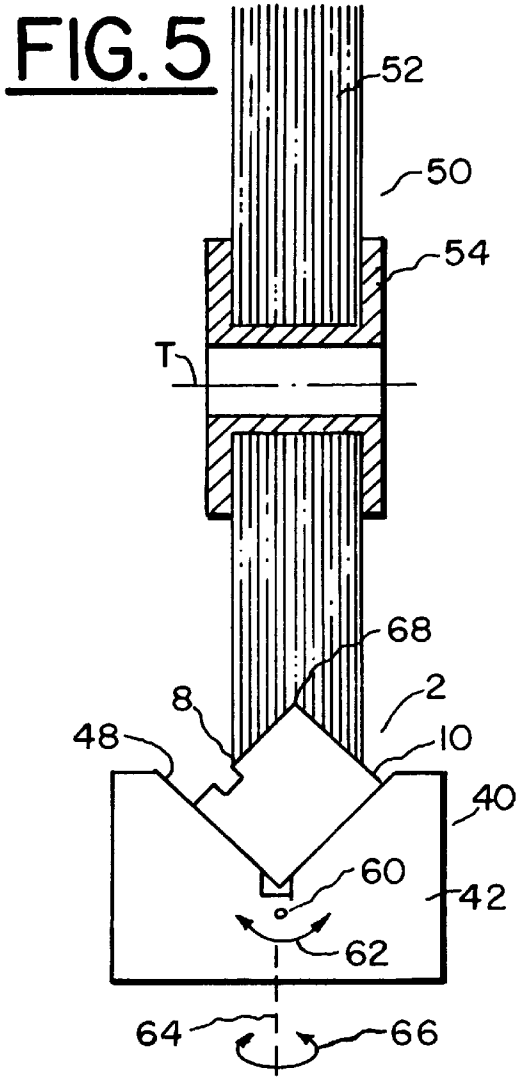
FIG. 5 is a transverse cross-sectional view of the arrangement shown in FIG. 4.
Figure 4:
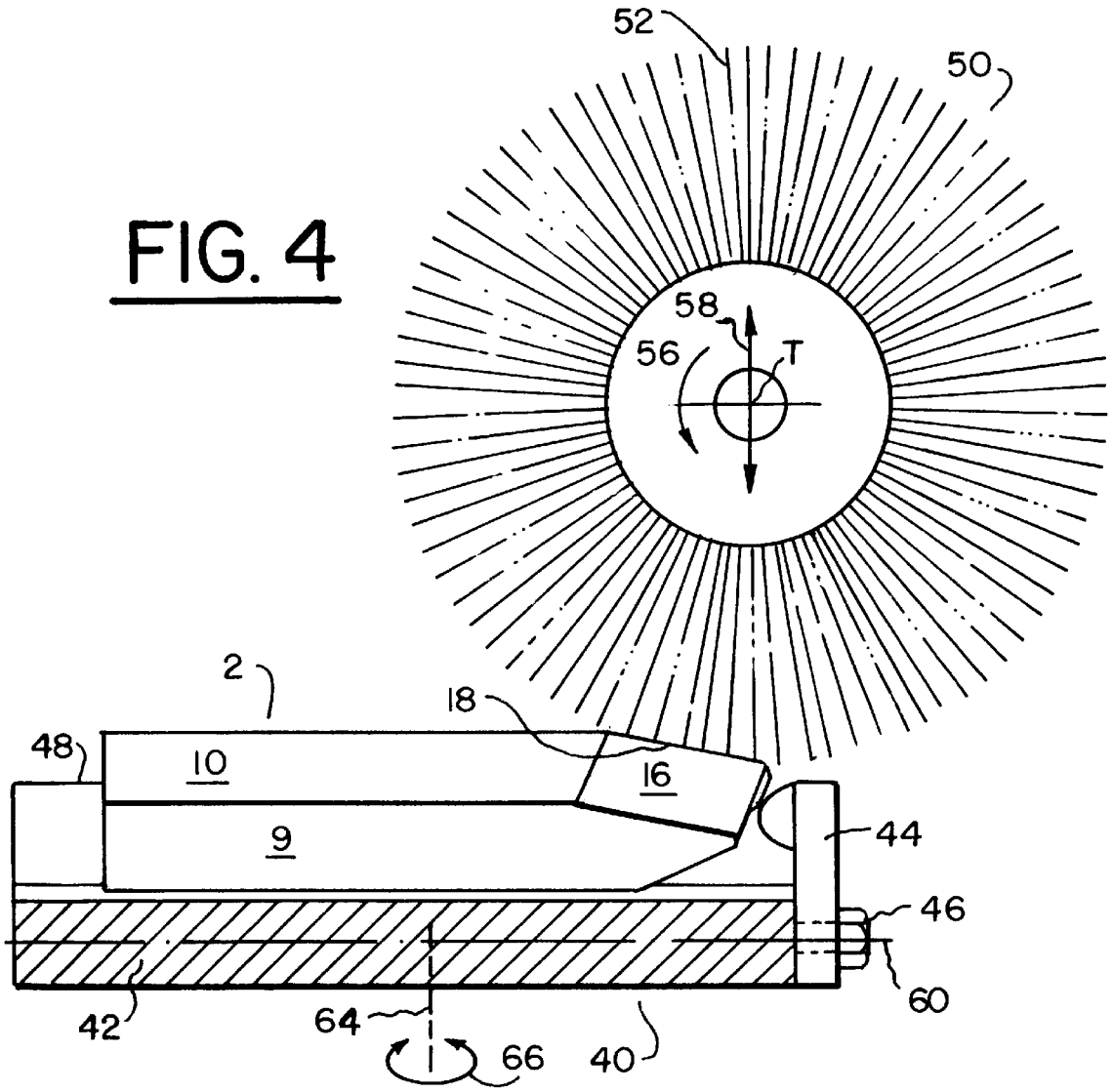
FIG. 4 illustrates a lengthwise cross-sectional view of mounting receptacle containing a cutting blade engaged with a rotating brush.

FIG. 4 and 5 illustrate an arrangement for securing the cutting blade for processing according to the inventive process. Cutting blade 2 is placed in a mounting receptacle 40 comprising a base 42 having a generally rectangular block-shape and including a V-shaped groove formed in a face thereof and extending the length of the base 42. The inclined surfaces of the V-shaped groove are designated by 48. Mounting receptacle 40 further includes a blade stop 44 attached to base 42 via screw 46. A brush 50 having bristles 52 (for example, 0.020 inch diameter bristles with 400 grid silicon carbide incorporated therein as described above) projecting from a central hub 54 is rotatable about an axis T. For non-limiting illustrative purposes only, the brush 50 is shown by arrow 56 to be rotatable in the counter clockwise direction. Brush 50 is movable relative to cutting blade 2 in the plunge direction along arrow 58 which describes the toward-and-away movement necessary to contact (and disengage) the brush 50 and cutting blade 2.

In some instances, it may be necessary to adjust the position of the brush 50 relative to the cutting blade mounting receptacle 40 to achieve a desired positioning of the brush relative to the cutting tool and mounting receptacle. This may be accomplished by angularly adjusting the orientation (arrow 62) of the mounting receptacle 40 relative to the brush 50 about an axis 60 parallel to the lengthwise direction of the mounting receptacle base 42. Alternative to angular positioning about axis 60, or in addition thereto, it may be necessary to angularly adjust the position (arrow 66) of the mounting receptacle 40 relative to the brush 50 about the axis 64 extending through the height of the mounting receptacle 40. Axis 64 is oriented perpendicular to the length and width directions of the base 42. Such angular adjustments will be discussed further below.

In practicing the present invention, a cutting blade 2 is placed cutting-edge-up into the V-shaped groove of the mounting receptacle 40, the tip is brought into contact with stop 44. Cutting blade 2 may be secured in the mounting receptacle 40 by any suitable clamping means such as by a C-clamp. Brush 50 is angularly positioned with respect to the cutting edge 18, preferably by orienting the brush axis T perpendicular to the cutting edge 18. The brush 50 is then rotated and moved relative to the mounting receptacle 40 (such as downward in FIG. 4 along direction 58) to bring the bristles 52 into contact with the cutting edge 18 and preferably also into contact with a portion of the front rake surface and cutting side profile surface 16 adjacent the cutting edge 18. This relative movement along direction 58 to bring the brush directly into contact with the cutting edge is hereafter referred to as plunge-feeding. The amount of pressure between the brush 50 and the cutting edge 18, which is controlled by the distance between them, can be adjusted depending on the desired amount of edge rounding and grid size of the abrasive incorporated into the bristles.

Alternative to plunge-feeding, and less preferred, brush 50 may be angularly oriented with respect to the cutting edge 18 as described above, positioned at a point beyond either end of cutting edge 18, and then moved relatively toward cutting blade 2 along direction 58 to a desired spacing from the cutting blade. The brush may then be fed relatively along the cutting edge 18, or at an angle of up to about +/−20° with respect thereto, to effect the rounding-off of the cutting edge 18 and preferably also provide a polished band adjacent the cutting edge 18 on each of the front surface 12 and the cutting side profile surface 16. The traversal rate should be such that the brush remains in contact with its respective portion of the cutting edge for the same amount of time as described above. Once the cutting edge has been traversed by the brush 50, relative movement along direction 58 takes place to move the brush 50 away from the cutting blade.

Generally it is sufficient to traverse the brush along a lengthwise path which follows the corner 68 defined by the intersection of the side 10 of the cutting blade adjacent the cutting side profile surface 16 and the front surface 8. The direction along the corner 68 usually varies little from the orientation of the cutting edge 18 when the cutting blade 2 is mounted in the cutting-edge-up position (FIG. 3) and as shown in the mounting receptacle 40 in FIG. 4. However, it is preferred to traverse the brush 50 substantially along the cutting edge 18 and this may require positional adjustments of the brush relative to the mounting receptacle 40 as described above.

In a similar manner for plunge-feeding, it is likewise usually sufficient to orient the axis T of the brush 50 to be perpendicular to the above-defined corner 68 since the orientation of the corner usually varies little from the orientation of the cutting edge 18 when the cutting blade 2 is mounted in the cutting-edge-up position (FIG. 3) and as shown in the mounting receptacle 40 in FIG. 4.

Figure 6:
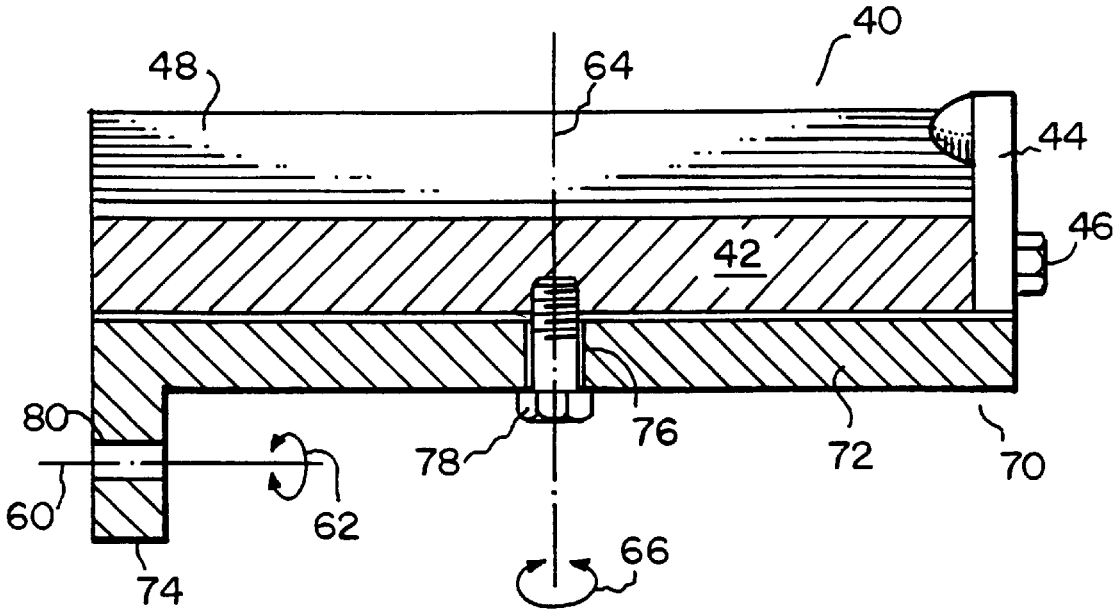
FIG. 6 is a lengthwise cross-sectional view of an adjustment plate which allows angular adjustment of the mounting receptacle.
Figure 7:
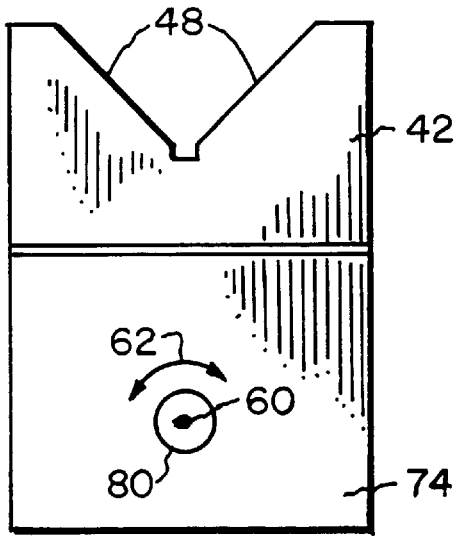
FIG. 7 is an end view of the adjustment plate and mounting receptacle of FIG. 6.

The above-mentioned positional adjustments may be made manually by including means with the mounting receptacle 40 which enable the adjustments to be effected directly at the mounting receptacle 40. For example, as seen in FIGS. 6 and 7, receptacle 40 may be pivotally mounted to an L-shaped adjustment plate 70 made of steel, for example, and comprising a long portion 72 and a short portion 74. Long portion 72 includes an opening 76, through which axis 64 passes, to allow passage of a screw 78 for threaded engagement with base 42 of mounting receptacle 40. By loosening screw 78, mounting receptacle 40 may be angularly adjusted by pivoting in either direction 66 about axis 64. Screw 78 is tightened once the desired orientation is achieved.

In a similar manner, the short portion 74 of adjustment plate 70 includes an opening 80 for passage of a screw (not shown) which serves not only to secure adjustment plate 70 in a suitable machine for carrying out the inventive brushing process, but which also allows angular adjustment about longitudinal axis 60 by pivoting in either direction 62.

It should be understood that the above description of manually adjusting the angular orientations of the cutting blade mounting receptacle is applicable to situations where simple brushing mechanisms are utilized. However, in situations where computer controlled multi-axis machines are utilized, such as a multi-axis CNC machine, the desired orientation of the mounting receptacle may be carried out by virtue of the available axes of motion on the machine. It will be appreciated and understood by the skilled artisan that specific mounting arrangements and/or angular adjustments will be dependent upon the particular machine being utilized to carry out the inventive process.

While not preferred, the present invention contemplates utilizing a brush without an abrasive incorporated in the bristles. Instead, abrasive in a suitable form (e.g. slurry, foam, etc.) may be added to the brush-cutting blade interface at the beginning of, or during, the brushing process.

The present invention may be carried out with brushes of differing bristle composition and/or stiffness, and abrasives of varying grid sizes. While nylon bristles are preferred, the invention should not be limited thereto. Instead, any bristle composition capable of effecting the desired rounding effect may be utilized. Generally, as brush stiffness and/or abrasive grid size increases, the amount of brushing time should be decreased as is noted in the examples above. Also, it can be expected that the rounding effect will become more prominent as brush stiffness and/or grid sizes increase as is also noted above. Furthermore, although silicon carbide is utilized as the abrasive in the examples, the present invention contemplates any suitable abrasive and should not be limited to silicon carbide.

Although the present invention has been discussed with reference to carbide cutting blades, it is not to be limited thereto. High speed steel cutting blades may also be treated by the inventive method as an alternative to the well-known, but inconsistent, manual edge treating method comprising stroking a soft steel pipe along the cutting edge at an angle of 60–90 degrees with respect thereto.

While the invention has been illustrated with a particular stick-type of cutting blade, the invention is not to be limited to such cutting blades. The present invention is applicable to all types and designs of stick-type cutting blades, including those also requiring sharpening of the front face, as well as those cutting blades known as "face-sharpened" or "form-relieved" and any other type of cutting blade where degradation of the cutting edge, especially degradation initially upon cutting, is of concern.

While the invention has been described with reference to preferred embodiments it is to be understood that the invention is not limited to the particulars thereof. The present invention is intended to include modifications which would be apparent to those skilled in the art to which the subject matter pertains without deviating from the spirit and scope of the appended claims.

What is claimed is:

1. A method of treating a cutting edge of a tool to reduce deterioration of said edge during a machining operation, said method comprising:

providing a tool having a cutting edge, said cutting edge being formed by the intersection of a front face and a cutting side profile surface, providing a rotatable brush having an axis of rotation and a plurality of bristles arranged about said axis, positioning said brush relative to said cutting edge, said axis being oriented perpendicular to said cutting edge or at an angle of up to about plus/minus 20 degrees with respect to the perpendicular orientation, rotating said brush, bringing said tool and said rotating brush into contact with one another in the presence of an abrasive material to effect a rounding-off of said cutting edge and a polishing of a portion of said front face and cutting side profile surface adjacent said cutting edge.

2. The method of claim 1 wherein said tool and said rotating brush are in contact for about 10 to about 20 seconds.

3. The method of claim 1 wherein said bristles comprise abrasive particles embedded therein.

4. The method of claim 1 wherein said abrasive particles have a grit size of about 100 to about 400.

5. The method of claim 1 wherein said abrasive comprises silicon carbide.

6. The method of claim 1 wherein said contact is achieved by plunge-feeding said brush relative to said cutting edge.

7. The method of claim 1 wherein said contact is achieved by moving brush relative to said tool along said cutting edge or at an angle of about plus/minus 20 degrees with respect to said cutting edge.

8. The method of claim 1 wherein said tool comprises carbide.

9. The method of claim 8 wherein said tool comprises tungsten carbide and cobalt.

10. The method of claim 1 wherein said tool comprises high speed steel.

11. The method of claim 1 further comprising prior to said positioning:

mounting said cutting tool in a mounting receptacle comprising a base having a length and width with a generally V-shaped groove extending along said length, said mounting receptacle having a stop means for abutment against one end of said cutting blade.

12. The method of claim 11 wherein said mounting receptacle is angularly adjustable about an axis extending parallel to said length.

13. The method of claim 11 wherein said mounting receptacle is angularly adjustable about an axis extending through said mounting receptacle, said axis being oriented perpendicular to both said length and said width.

* * * * *